US011839900B2

(12) United States Patent
Carter et al.

(10) Patent No.: US 11,839,900 B2
(45) Date of Patent: Dec. 12, 2023

(54) MATERIAL PROCESSING SCREEN PLANT DRIVE SYSTEM

(71) Applicant: Terex USA, LLC, Westport, CT (US)

(72) Inventors: Rex Mikle Carter, Newcastle, OK (US); Michael Peter Stemper, Marion, IA (US); Alexander Evan Ross, Washington, IA (US); Ryan Anthony Mumm, Newhall, IA (US)

(73) Assignee: Terex USA, LLC, Westport, CT (US)

( * ) Notice: Subject to any disclaimer, the term of this patent is extended or adjusted under 35 U.S.C. 154(b) by 0 days.

(21) Appl. No.: 17/575,886

(22) Filed: Jan. 14, 2022

(65) Prior Publication Data

US 2022/0134382 A1 May 5, 2022

Related U.S. Application Data

(63) Continuation of application No. 16/857,726, filed on Apr. 24, 2020, now Pat. No. 11,224,896, which is a continuation of application No. 15/682,784, filed on Aug. 22, 2017, now Pat. No. 10,632,501.

(60) Provisional application No. 62/378,066, filed on Aug. 22, 2016.

(51) Int. Cl.

| | |
|---|---|
| ***B07B 1/00*** | (2006.01) |
| ***B07B 13/16*** | (2006.01) |
| ***B07B 1/36*** | (2006.01) |
| ***B07B 1/42*** | (2006.01) |

(52) U.S. Cl.

CPC ..... *B07B 1/005* (2013.01); *B07B 1/36* (2013.01); *B07B 1/42* (2013.01); *B07B 13/16* (2013.01)

(58) Field of Classification Search

CPC .. B07B 1/005; B07B 1/36; B07B 1/42; B07B 1/44

See application file for complete search history.

(56) References Cited

U.S. PATENT DOCUMENTS

| | | | | |
|---|---|---|---|---|
| 2,891,395 | A * | 6/1959 | Chater | F16D 3/68 464/89 |
| 2,943,464 | A * | 7/1960 | Voges | F16D 3/68 464/178 |
| 3,099,349 | A | 7/1963 | Sinden | |
| 3,439,806 | A | 4/1969 | Kass et al. | |
| 3,444,999 | A | 5/1969 | Hurst | |
| 3,608,388 | A | 9/1971 | Huber | |
| 4,256,572 | A | 3/1981 | Read | |
| 4,520,920 | A | 6/1985 | Ray | |
| 5,232,098 | A | 8/1993 | St-Pierre et al. | |
| 6,029,822 | A | 2/2000 | Skoropa | |
| 6,533,217 | B2 | 3/2003 | Lind | |
| 8,083,072 | B2 | 12/2011 | Botton et al. | |
| 8,162,245 | B2 | 4/2012 | Sauser et al. | |

(Continued)

*Primary Examiner* — Joseph C Rodriguez

(74) *Attorney, Agent, or Firm* — Simmons Perrine Moyer Bergman PLC

(57) ABSTRACT

A screen drive for a mobile material processing screen which can be at a travel width without having to fold or disable the screen drive. The screen drive system includes a drive motor, which is tucked at least partially under the vibrating screen; a sheave, having a double row ball bearing being supported by a shaft; a belt, coupling sheave and drive motor; a drive shaft coupled to a first universal joint, and a second universal joint, which is coupled to an opposing end of the drive shaft and to sheave.

9 Claims, 10 Drawing Sheets

(56) References Cited

U.S. PATENT DOCUMENTS

| | | | | |
|---|---|---|---|---|
| 8,740,464 | B2 | 6/2014 | Berns | |
| 8,820,536 | B2 * | 9/2014 | Schirm | B07B 1/46 209/420 |
| 9,085,015 | B2 | 7/2015 | Schirm et al. | |
| 9,433,977 | B2 | 9/2016 | Zhu | |
| 9,776,805 | B2 | 10/2017 | Groenewald | |
| 10,105,819 | B2 | 10/2018 | Ray | |
| 10,632,501 | B2 | 4/2020 | Carter et al. | |
| 2003/0173265 | A1 | 9/2003 | Cohen et al. | |
| 2009/0123099 | A1 | 5/2009 | Dickerhoff et al. | |
| 2013/0037450 | A1 * | 2/2013 | Schirm | B07B 1/28 209/233 |
| 2013/0037454 | A1 * | 2/2013 | Schirm | B07B 13/16 209/404 |

* cited by examiner

MATERIAL PROCESSING SCREEN PLANT DRIVE SYSTEM

CROSS REFERENCE TO RELATED APPLICATIONS

The present application is a continuation of the non-provisional application having Ser. No. 16/857,726 filed on Apr. 24, 2020, which application is a continuation of the non-provisional application having Ser. No. 15/682,784 filed on Aug. 22, 2017 now U.S. Pat. No. 10,632,501 issued on Apr. 28, 2020, which non-provisional application claims the benefit of the filing date of provisional patent application having Ser. No. 62/378,066 filed on Aug. 22, 2016 by the same inventors, which applications are incorporated herein in their entirety by this reference.

FIELD OF THE INVENTION

The present invention relates to improved systems and methods for processing aggregate and recycled material.

BACKGROUND OF THE INVENTION

The present invention relates generally to material processing plants and more particularly to screen plants and methods of constructing and utilizing the same.

More particularly, the present invention relates to portable, self-contained and efficient material processing screen plants. Many prior art material processing screen plants often failed to meet some of the industry needs.

Often, material processing screen plants are very large and they must be disassembled or reconfigured before they have a travel width dimension less than the maximum allowed. This disassembly process can be time consuming and may require use of specialized skills.

SUMMARY OF THE INVENTION

It is an object of the present invention to provide an efficient mobile material processing screening plant.

It is a feature of the present invention to include a mobile screen plant which does not require folding or disassembly of the screen drive to place the screen plant in a transport width configuration.

It is another feature of the present invention to tuck the electric drive motor under the screen and exposing only a small portion to provide clearance for a belt, sheave and support structure.

It is another feature to include a sheave supporting stub shaft, which is disposed on an opposite side of the screen walkway from the screen side panel.

It is an advantage of the present invention to provide for efficient set up and transportation of a mobile material processing screen plant.

The present invention is designed to achieve the above-mentioned objectives, include the previously stated features, and provide the aforementioned advantages.

An embodiment of the present invention comprises a screen having an electric drive motor tucked under the screen and extending less than half its length dimension beyond the edge of the screen, a stub shaft supporting a sheave with a stub shaft bearing therein.

Another embodiment of the present invention comprises a method of changing an angle of inclination of a screen plant, where minor changes in screen angle of inclination can be accommodated by the design of the drive shaft and u-joints. In other changes, the stub shaft can be moved to a new bolting location to accommodate larger changes in angles of inclination. When the stub shaft is moved, either a belt is replaced or a belt tensioner is adjusted.

The present invention includes a mobile material processing vibrating screen, comprising:

- a vibrating screen plant, of a type being configured with a predetermined travel width dimension;
- a walkway disposed on said vibrating screen plant which is sized and located to permit ambulation thereon of a maintenance worker;
- a screen drive system operatively coupled to a vibrating screen disposed on said vibrating screen plant, said screen drive system configured with:
- a drive motor, which is disposed at least partially below a level of the vibrating screen;
- a sheave;
- a belt, coupling the sheave and the drive motor;
- a drive shaft coupled to a first joint;
- a second joint, which is coupled to an opposing end of the drive shaft and to said sheave;
- a bearing;
- wherein said drive motor is an electric drive motor system;
- an adapter;
- wherein said adapter is coupled to a hub and to said first joint which is coupled to said drive shaft; and
- said second joint further being coupled to:
  - a shaft; and
  - said bearing.

The present invention can also be a method of processing material with a vibrating screen at multiple locations comprising the steps of:

- providing, at a first location, a vibrating screen plant, of a type being configured to be transported, and which has a screen drive system with:
  - a drive motor, which is located at least partially below a level of a vibrating screen;
  - a sheave;
  - a belt, coupling said sheave and said drive motor;
  - a drive shaft coupled to a first joint;
  - a second joint, which is coupled to an opposing end of the drive shaft and to said sheave;
  - operating said vibrating screen plant at said first location;
  - transporting said vibrating screen plant to a second location without reconfiguring said screen drive system; and
  - operating said vibrating screen plant at said second location.

DETAILED DESCRIPTION OF THE INVENTION

Figure 1:
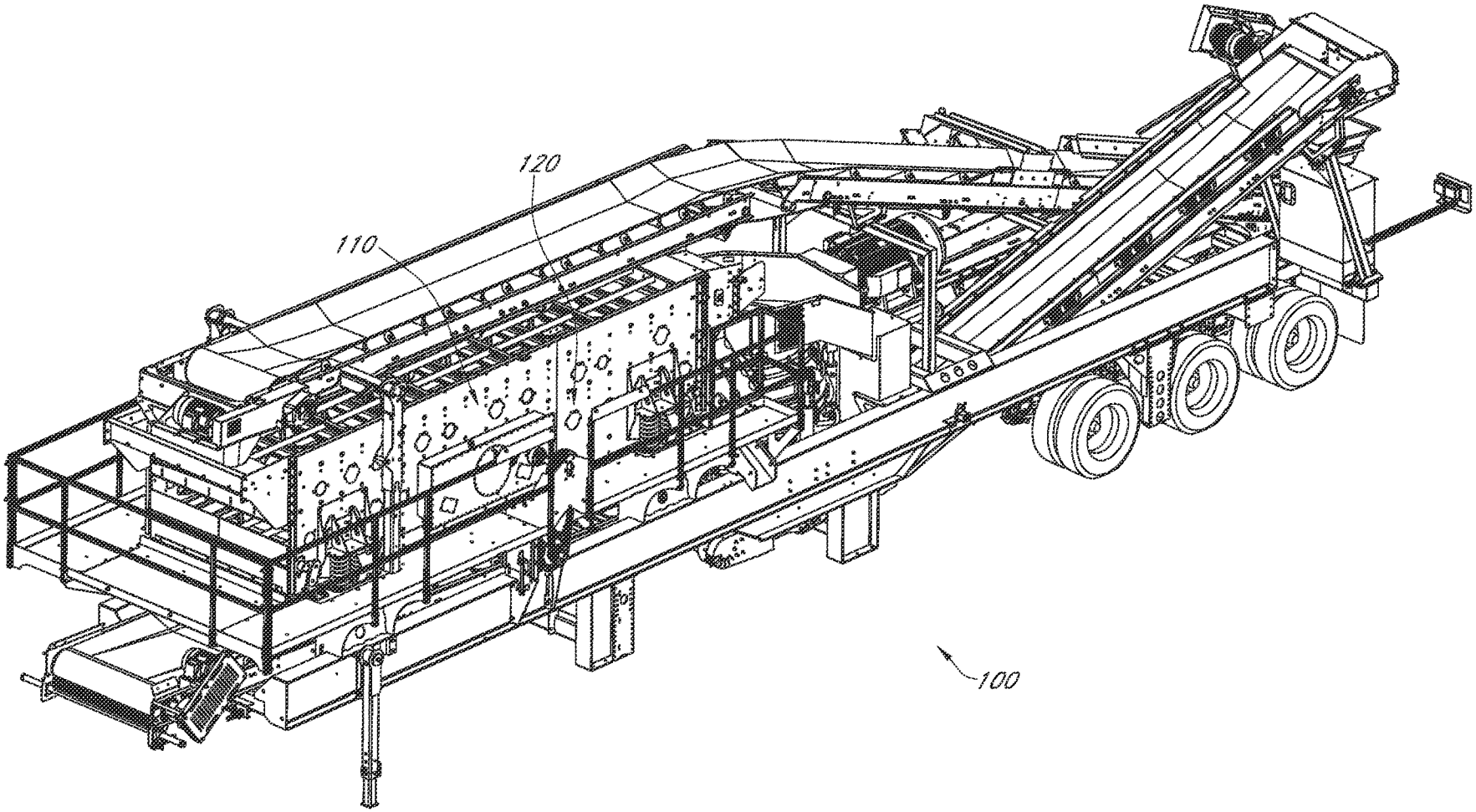
FIG. 1 is a perspective view of a material processing plant of the present invention.

Now referring to the drawings wherein like numerals refer to like structure shown in the drawings and text included in the application throughout.

In FIG. 1, there is shown a mobile screen plant 100 having a variably inclinable vibrating screen 110 and a screen drive system 120 with drive housing 122.

Figure 2:
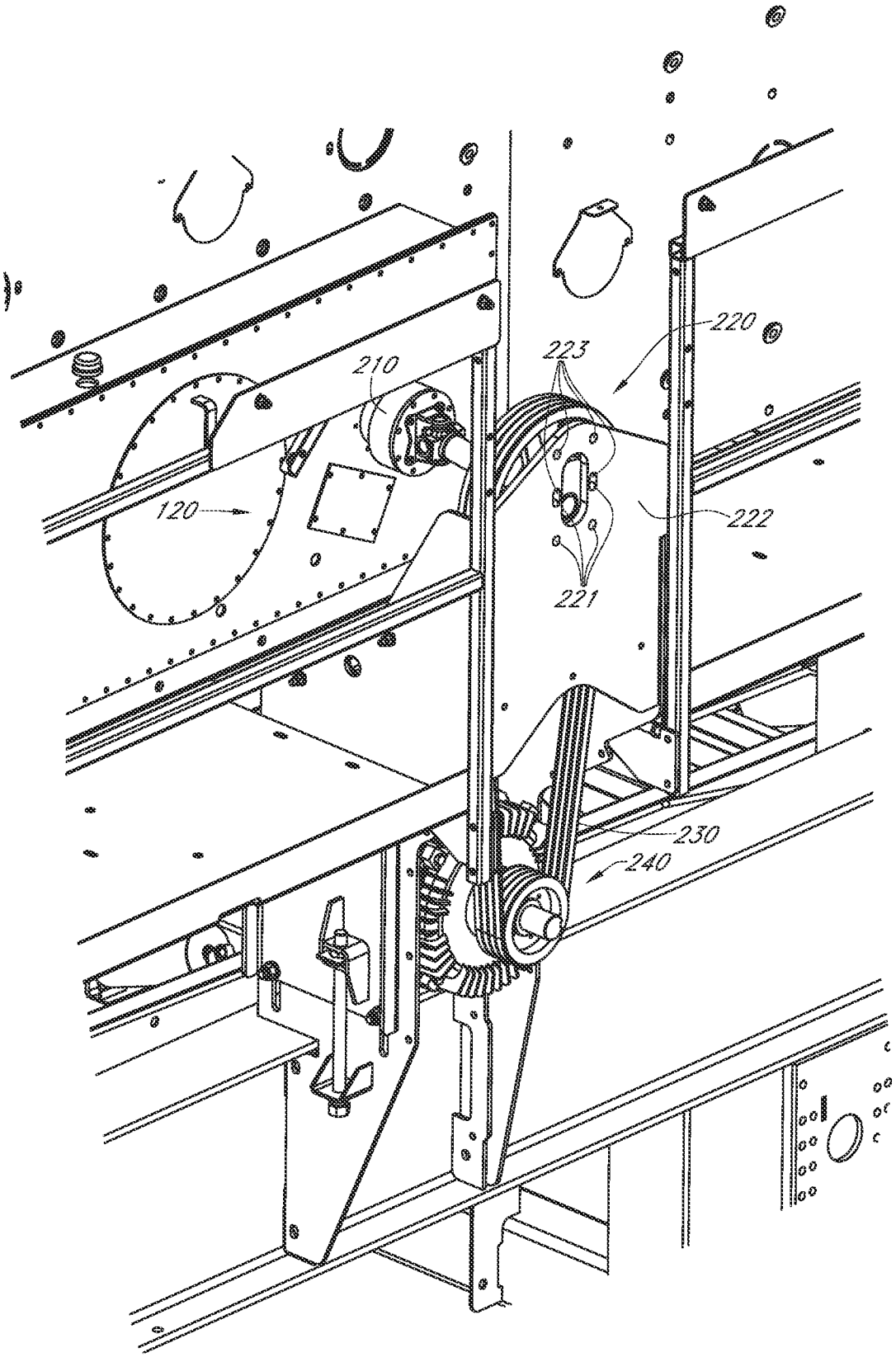
FIG. 2 is close up view of a portion of the plant of FIG. 1.
Figure 3:
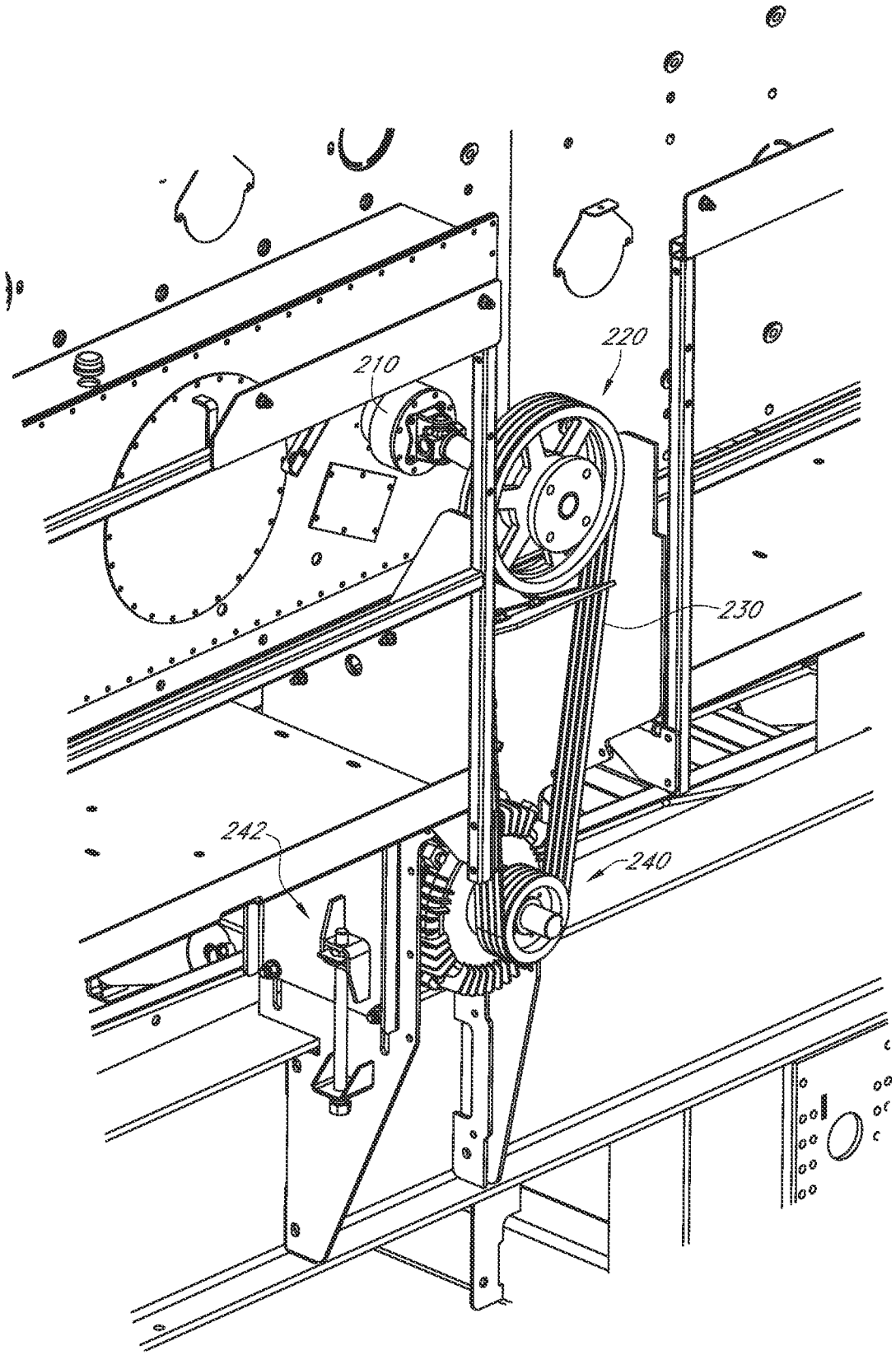
FIG. 3 is a portion of FIG. 2 with a guard removed to show underlying detail.

In FIGS. 2 and 3, there is shown an interface 210 to an internal screen shaft (not shown, but well known in the art), a sheave 220, a bottom array of stub shaft bolt holes 221, a screen drive mount 222, a top stub shaft mounting hole array 223 (note that the top array 223 of four holes shares two holes with the bottom array 221), a belt 230 and an electric drive motor system 240, with motor shaft distal end 241.

Figure 4:
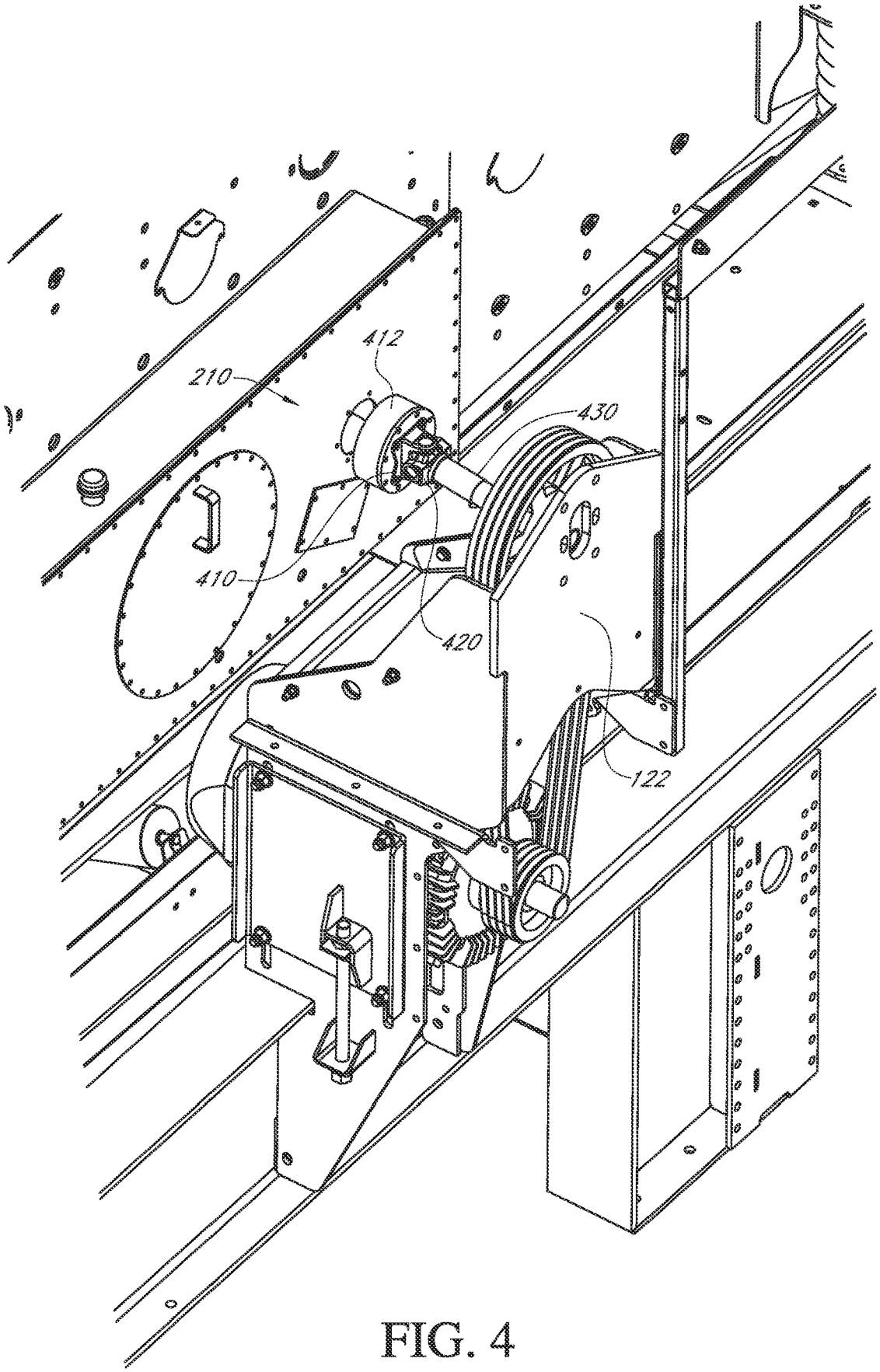
FIG. 4 is a portion of the plant shown in FIG. 2 but from an elevated location.
Figure 5:
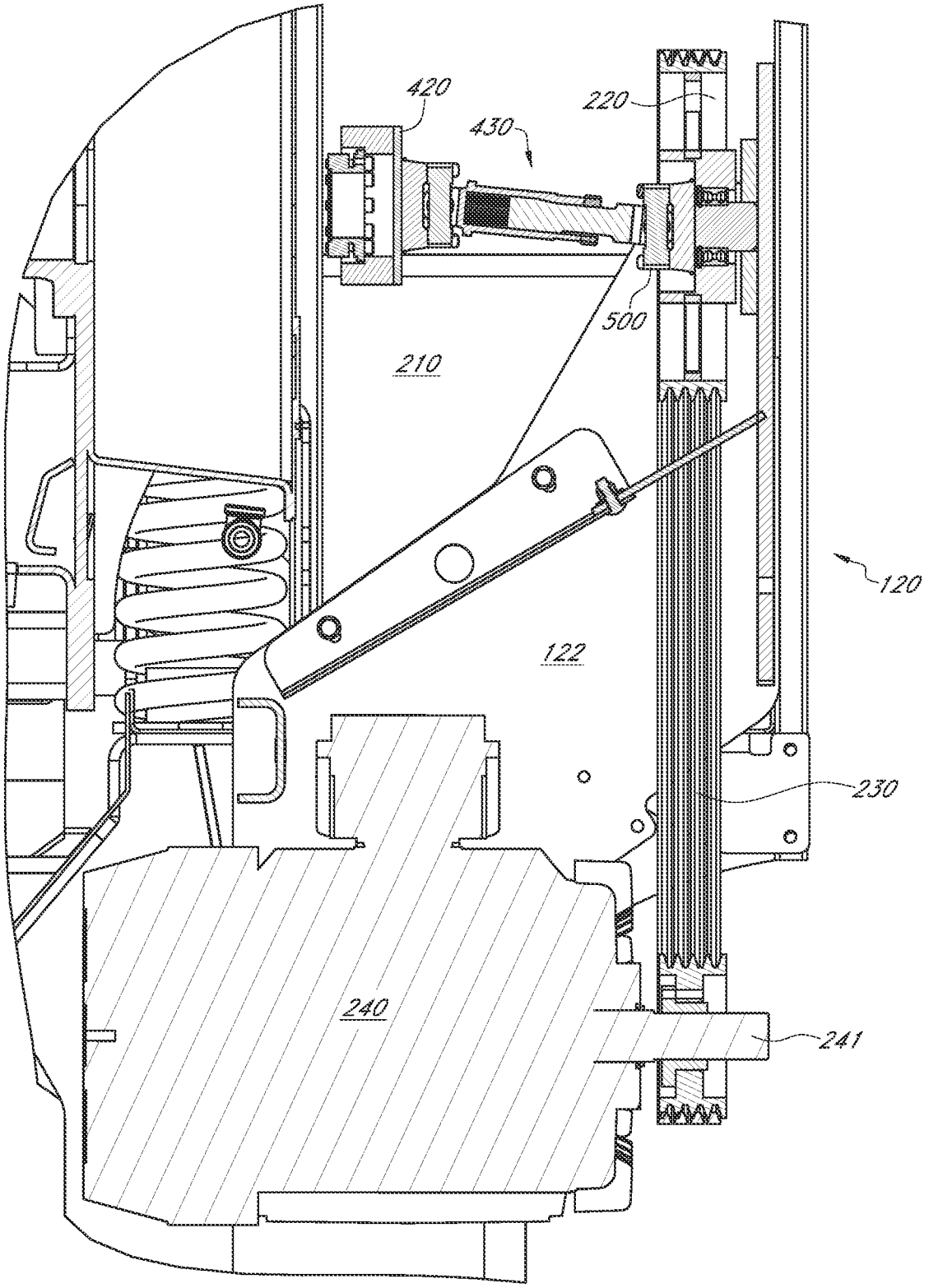
FIG. 5 is a side view of a portion of the plant of FIG. 2 with a different guard having been removed to reveal underlying details.
Figure 6:
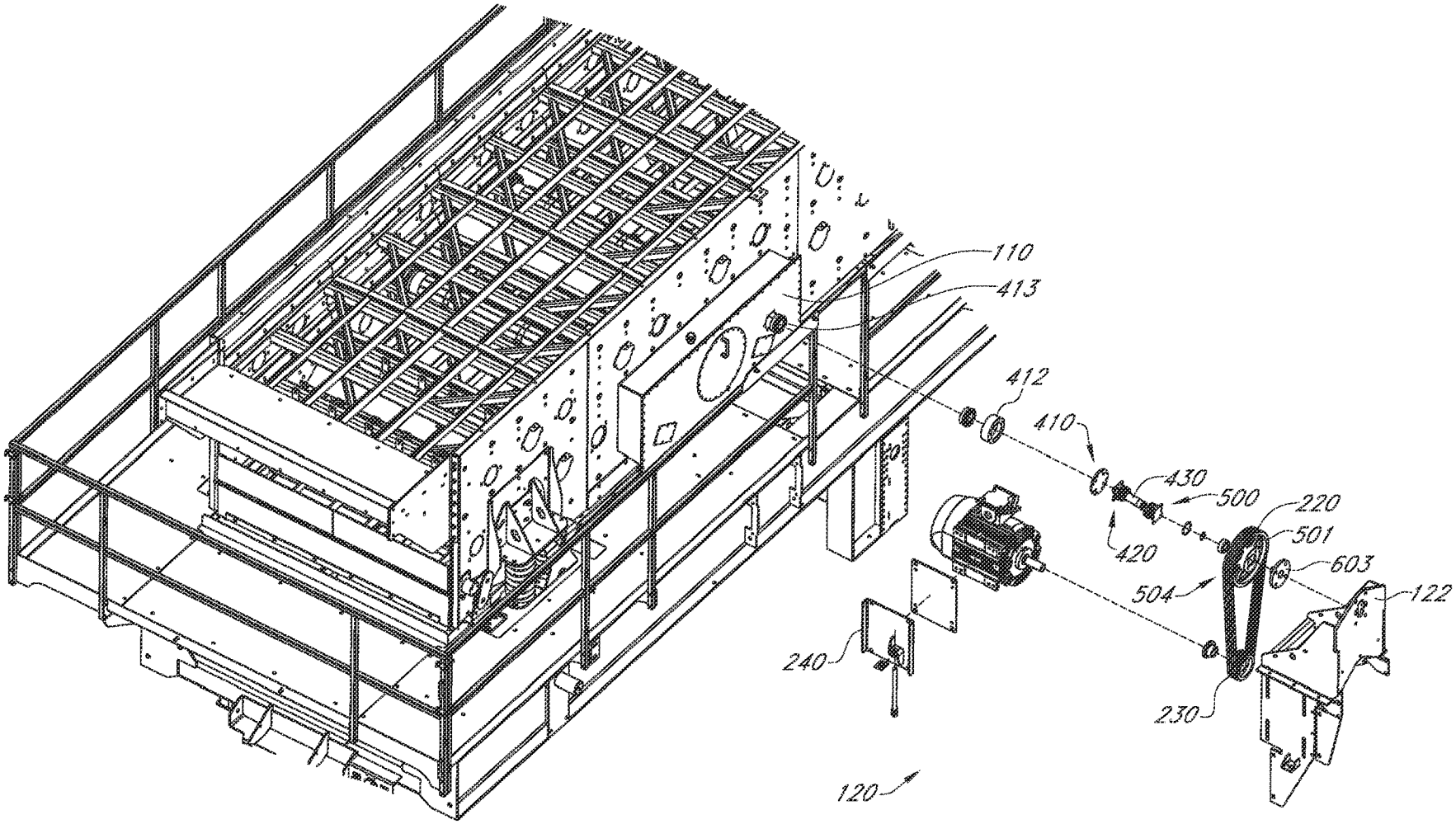
FIG. 6 is an exploded view of the portion of FIG. 2.
Figure 7:
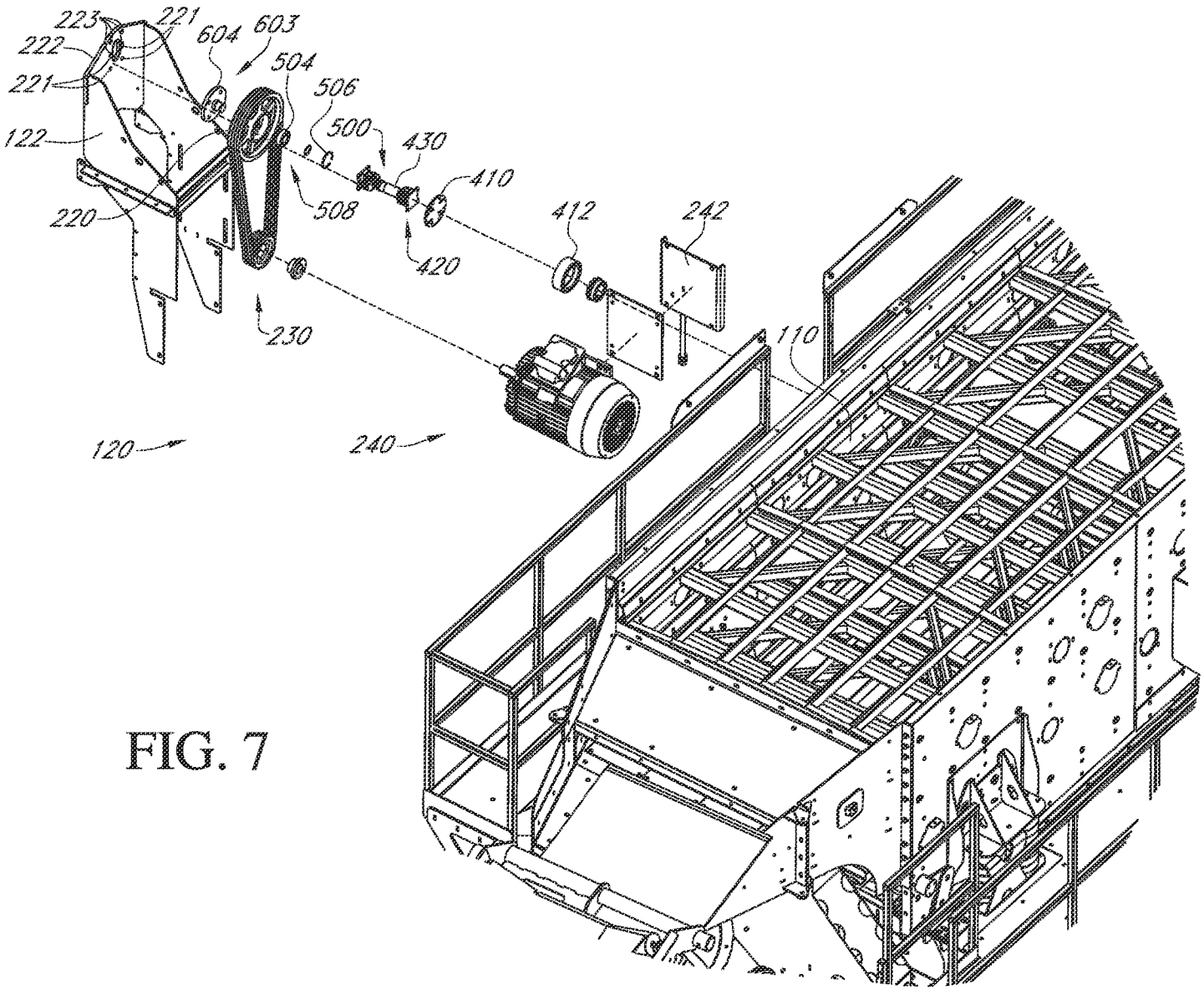
FIG. 7 is an alternate angle view of the exploded portion of FIG. 6.
Figure 8:
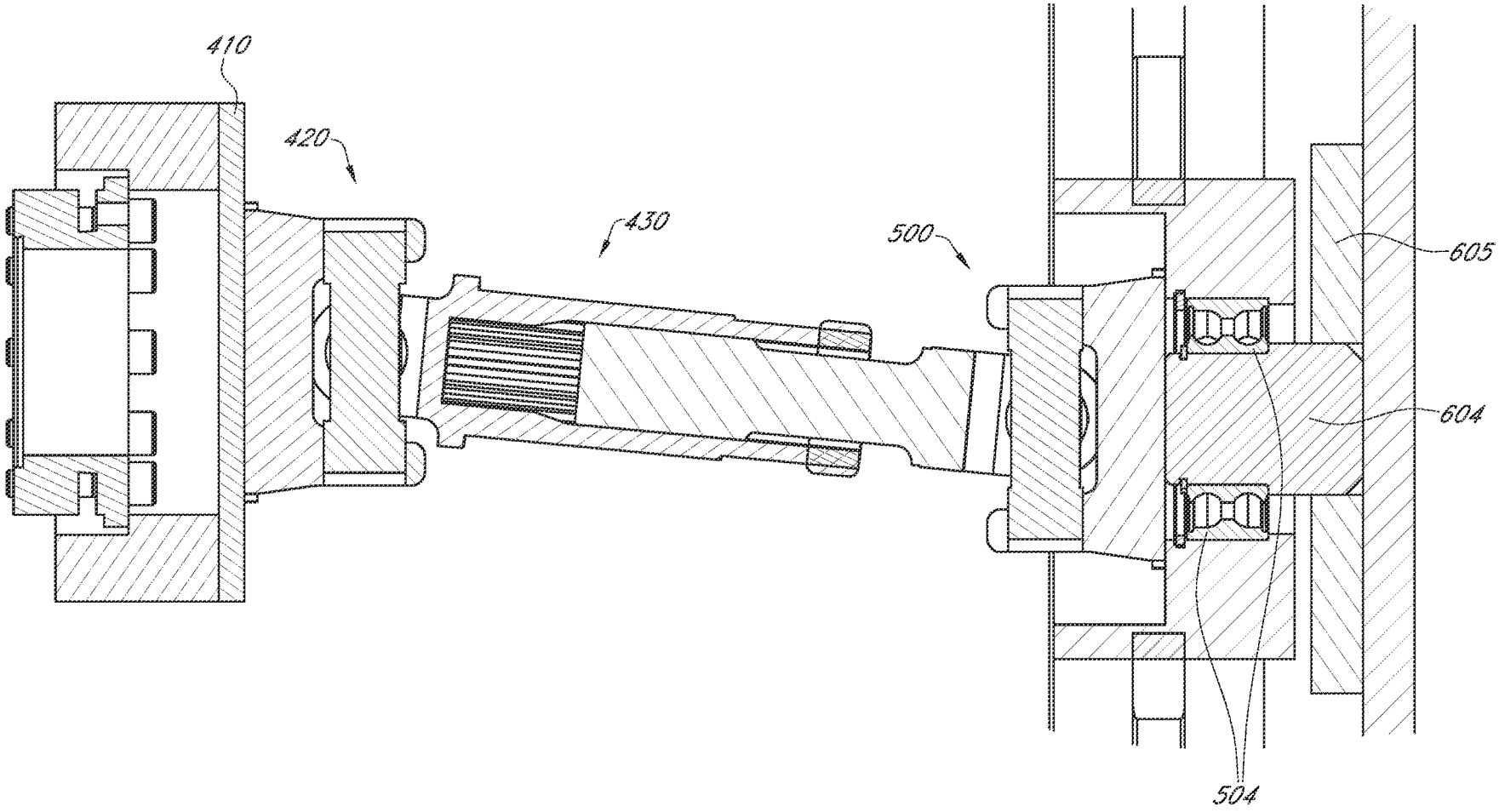
FIG. 8 is a cross-sectional view of a portion of the present invention.
Figure 9:
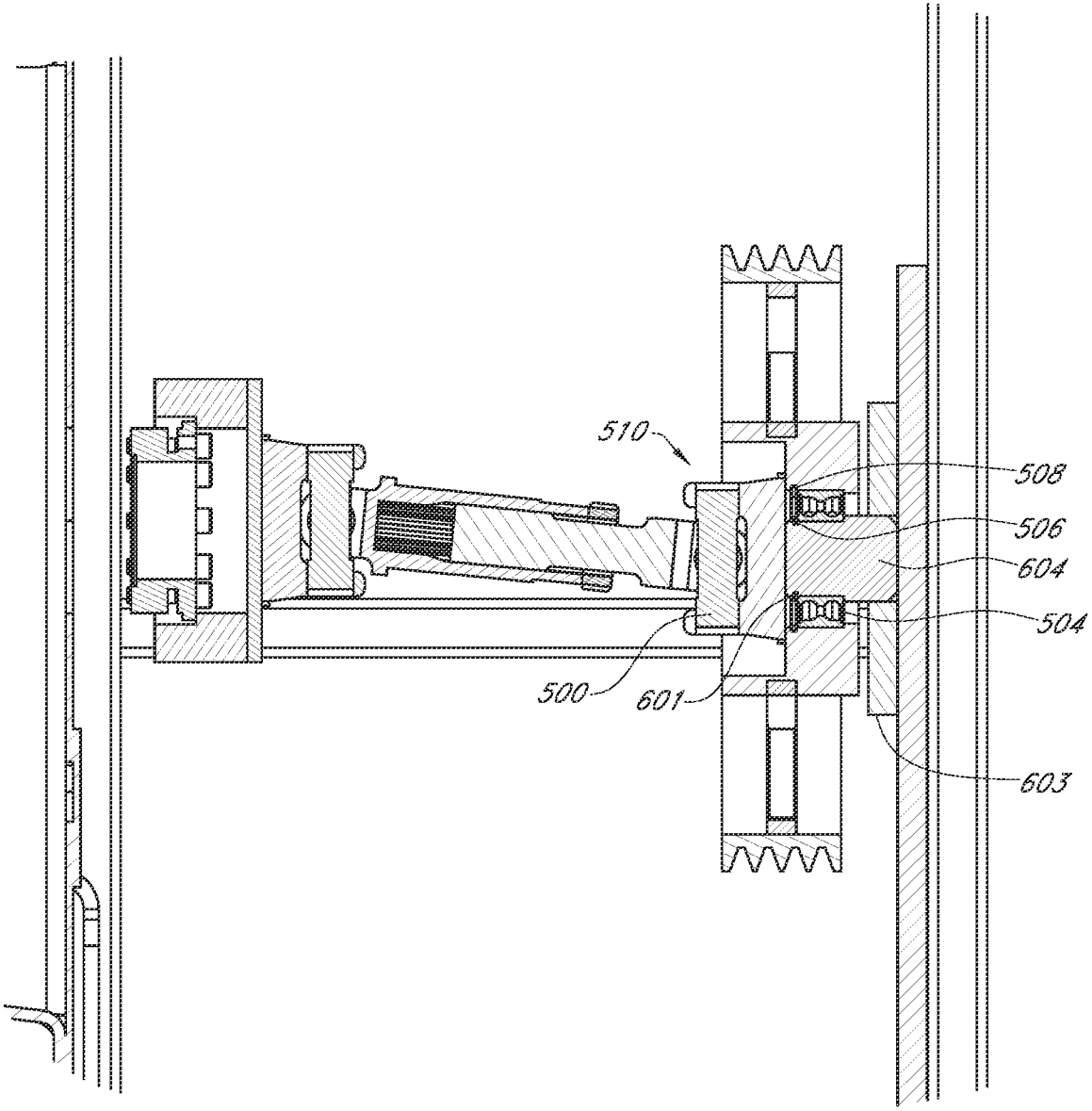
FIG. 9 is a close-up view of a terminal portion of the invention shown in FIG. 8.
Figure 10:
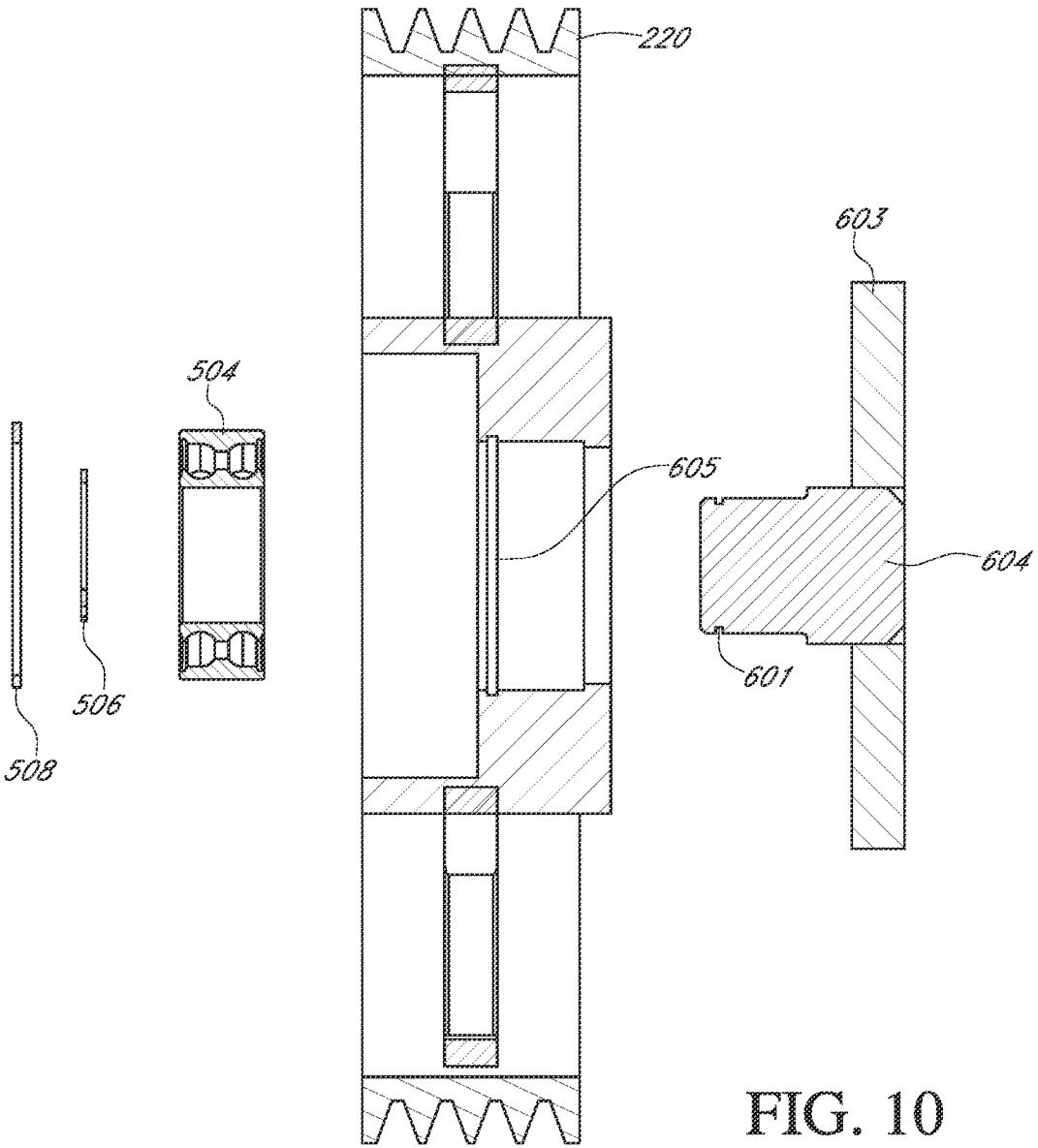
FIG. 10 is an exploded view of a portion of FIG. 9.

In FIG. 4, the interface 210 includes adapter plate 410, which is shown coupled to ring feeder hub 412 and to universal joint 420 which is coupled to drive shaft 430.

In FIGS. 5-10, there is shown a second universal joint 500, which is coupled, via bolts (not shown) at its flanged yoke 510 and at its distal end to sheave bolt holes 501 in sheave 220 and at its proximal end to the opposing end of the drive shaft 430. Also shown is stub-shaft 603, double row ball bearing 504, inner C-Clip 506, which retains (I.D.) of bearing, outer C-Clip 508 which retains outside diameter (O.D.) of double row ball bearing 504. Also shown in exploded views are outer C-clip 508, inner c clip 506, inner c-clip shaft groove 601, stub shaft 603, with non-flange portion 604, outer c-clip sheave groove 605, double row ball bearing 504 and sheave 220.

The present invention can operate as follows: an electric drive motor system 240 is tucked at least partially under the deck portion of the mobile screen plant 100 where the motor shaft distal end 241 extends away from the screen but inside the travel width dimension, so that no manipulation of the electric drive motor system 240 is required during conversion of the mobile screen plant 100 from operation mode to transport mode. Drive belt tensioning system 242 may be used to tension the belt 230, which turns sheave 220, which is mounted through double row ball bearing 504 on non-flange portion 604 of stub-shaft 603, which is mounted to drive housing 122. Sheave 220 is coupled to the flanged yoke 510 of second universal joint 500, which connects the drive shaft 430 to the interface 210 to the internal drive system of variably inclinable vibrating screen 110.

Although the invention has been described in detail in the foregoing for the purpose of illustration, it is to be understood that such detail is solely for that purpose and that variations can be made therein by those of ordinary skill in the art without departing from the spirit and scope of the invention as defined by the following claims, including all equivalents thereof.

It is thought that the method and apparatus of the present invention will be understood from the foregoing description, and that it will be apparent that various changes may be made in the form, construct steps, and arrangement of the parts and steps thereof, without departing from the spirit and scope of the invention, or sacrificing all of their material advantages. The form herein described is merely a preferred exemplary embodiment thereof.

We claim:

1. A mobile material processing vibrating screen plant, comprising:
- a vibrating screen plant with a predetermined travel width dimension;
- a walkway disposed on said vibrating screen plant which is sized and located to permit ambulation of a person thereon;
- a screen drive system operatively coupled to a vibrating screen disposed on said vibrating screen plant, said screen drive system configured with:
  - a drive motor, which is disposed at least partially below a level of the vibrating screen;
  - a sheave;
  - a belt, coupling the sheave and the drive motor;
  - a first shaft coupled to said sheave;
  - an interface;
  - a bearing;
  - said screen drive system further being deployed to drive the vibrating screen without needing to be reconfigured to attain said predetermined travel width dimension;
  - wherein said interface is coupled to said first shaft;
  - a second shaft;
  - said first shaft is a drive shaft coupled through a first universal joint to said sheave; and
  - said second shaft is a stub-shaft.

2. A method of processing material with a vibrating screen plant at multiple locations comprising the steps of:
- providing, at a first location, a vibrating screen plant, of a type being configured to be transported, and which has a screen drive system with:
  - a drive motor, which is located at least partially below a level of a vibrating screen;
  - a sheave;
  - a belt, coupling said sheave and said drive motor;
  - a drive shaft coupled to a first joint;
  - a second joint, which is coupled to an opposing end of the drive shaft and to said sheave; and
  - a second shaft, which is a stub-shaft;
- operating said vibrating screen plant at said first location;
- transporting said vibrating screen plant to a second location without reconfiguring said screen drive system; and
- operating said vibrating screen plant at said second location.

3. The method of claim 2 wherein said bearing is a double row ball bearing.

4. The method of claim 3 wherein said first joint is a universal joint.

5. The method of claim 4 wherein said step of transporting is done by coupling a semi-tractor to a portion and pulling the vibrating screen plant on a roadway.

6. The method of claim 5 wherein said portion is a portion of said vibrating screen plant.

7. A mobile material processing vibrating screen plant, comprising:
- a vibrating screen plant with a predetermined travel width dimension;
- a portion of said vibrating screen plant which is sized and located to permit ambulation of a person thereon;
- a screen drive system operatively coupled to a vibrating screen disposed on said vibrating screen plant, said screen drive system configured with:
  - a drive motor, which is disposed at least partially below a level of the vibrating screen;
  - a sheave;

a belt, coupling the sheave and the drive motor;

a first shaft coupled to said sheave;

an interface;

a bearing;

said screen drive system further being deployed to drive the vibrating screen without needing to be reconfigured to attain said predetermined travel width dimension;

wherein said interface is coupled to said first shaft;

a second shaft; and said first shaft is a drive shaft coupled to said sheave.

8. The mobile material processing vibrating screen plant of claim 7 wherein said second shaft is a stub-shaft.

9. The mobile material processing vibrating screen plant of claim 8 wherein said first shaft is a drive shaft coupled through a first universal joint to said sheave.

* * * * *